US010932535B2

(12) United States Patent
Du et al.

(10) Patent No.: US 10,932,535 B2
(45) Date of Patent: Mar. 2, 2021

(54) OUTDOOR SUNSHADE UMBRELLA AND METHOD FOR USING THE SAME

(71) Applicant: BOE TECHNOLOGY GROUP CO., LTD., Beijing (CN)

(72) Inventors: Zhihong Du, Beijing (CN); Wenbo Li, Beijing (CN); Xinguo Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 164 days.

(21) Appl. No.: 16/257,049

(22) Filed: Jan. 24, 2019

(65) Prior Publication Data

US 2019/0298016 A1 Oct. 3, 2019

(30) Foreign Application Priority Data

Mar. 27, 2018 (CN) ..... 201810256959.X

(51) Int. Cl.

| | |
|---|---|
| ***A45B 17/00*** | (2006.01) |
| ***A45B 23/00*** | (2006.01) |
| *A45B 25/16* | (2006.01) |
| *A45B 25/00* | (2006.01) |

(52) U.S. Cl.

CPC ..... *A45B 17/00* (2013.01); *A45B 23/00* (2013.01); *A45B 25/16* (2013.01); *A45B 2017/005* (2013.01); *A45B 2023/0012* (2013.01); *A45B 2023/0031* (2013.01); *A45B 2023/0037* (2013.01); *A45B 2023/0075* (2013.01); *A45B 2023/0081* (2013.01); *A45B 2025/003* (2013.01); *A45B 2200/1045* (2013.01)

(58) Field of Classification Search

CPC ..... A45B 17/00; A45B 2017/005; A45B 2023/0075; A45B 2023/0081; A45B 2200/1045

See application file for complete search history.

(56) References Cited

U.S. PATENT DOCUMENTS

| | | | | |
|---|---|---|---|---|
| 6,511,033 | B2 | 1/2003 | Li | |
| 6,923,193 | B2 * | 8/2005 | Chen | A45B 17/00 |
| 7,128,076 | B2 * | 10/2006 | Freedman | A45B 11/00 135/20.3 |

(Continued)

FOREIGN PATENT DOCUMENTS

| | | |
|---|---|---|
| CN | 201640770 U | 11/2010 |
| CN | 202179221 U | 4/2012 |

(Continued)

OTHER PUBLICATIONS

First Chinese Office Action dated Apr. 30, 2019, received for corresponding Chinese Application No. 201810256959.X.

*Primary Examiner* — David R Dunn
*Assistant Examiner* — Danielle Jackson
(74) *Attorney, Agent, or Firm* — Kinney & Lange, P.A.

(57) ABSTRACT

An outdoor sunshade umbrella and a method for using the same are provided. The outdoor sunshade umbrella includes: a supporting portion; a sunshade umbrella main body pivotally connected with the supporting portion; and a control portion. The control portion is used to control the supporting portion to automatically adjust a position of the sunshade umbrella main body according to a direction of sunlight and position information of an obscured object.

19 Claims, 5 Drawing Sheets

(56) References Cited

U.S. PATENT DOCUMENTS

| | | | | |
|---|---|---|---|---|
| 7,407,178 | B2 * | 8/2008 | Freedman | A45B 11/00 135/20.3 |
| 7,497,225 | B1 * | 3/2009 | Klein, Jr. | A45B 3/00 135/118 |
| 7,631,653 | B2 * | 12/2009 | Young | A45B 17/00 135/15.1 |
| 8,061,374 | B2 * | 11/2011 | Li | A45B 23/00 135/16 |
| 8,413,671 | B2 * | 4/2013 | Li | A45B 17/00 248/521 |
| 8,807,513 | B2 * | 8/2014 | Volin | A45B 17/00 248/521 |
| 9,289,038 | B2 * | 3/2016 | Ma | A45B 23/00 135/16 |
| 9,433,268 | B2 | 9/2016 | Ma | |
| 9,565,907 | B2 * | 2/2017 | Ma | A45B 17/00 |
| 9,839,267 | B1 * | 12/2017 | Gharabegian | A45B 17/00 |
| 9,951,541 | B1 * | 4/2018 | Gharabegian | A45B 17/00 |
| 10,094,138 | B2 * | 10/2018 | Gharabegian | A45B 23/00 |
| 10,617,183 | B2 * | 4/2020 | Gharabegian | A45B 23/00 |
| 10,617,184 | B2 * | 4/2020 | Ma | A45B 17/00 |
| 2006/0042293 | A1 * | 3/2006 | Ma | A45B 3/00 62/304 |
| 2012/0097202 | A1 * | 4/2012 | Chen | A45B 17/00 |
| 2014/0158173 | A1 | 6/2014 | Li et al. | |
| 2016/0183647 | A1 * | 6/2016 | Ma | A45B 17/00 135/20.1 |
| 2017/0367447 | A1 * | 12/2017 | Bauer | A45B 17/00 |
| 2018/0332935 | A1 * | 11/2018 | Gharabegian | A45B 17/00 |
| 2019/0037985 | A1 | 2/2019 | Jin | |
| 2019/0069652 | A1 * | 3/2019 | Rosedale | A45B 17/00 135/20.1 |

FOREIGN PATENT DOCUMENTS

| | | | |
|---|---|---|---|
| CN | 202890770 | U | 4/2013 |
| CN | 203662144 | U | 6/2014 |
| CN | 104757757 | A | 7/2015 |
| CN | 104760048 | A | 7/2015 |
| CN | 205214453 | U | 5/2016 |
| CN | 105901860 | A | 8/2016 |
| CN | 205831281 | U | 12/2016 |
| CN | 205848922 | U | 1/2017 |
| CN | 106388174 | A | 2/2017 |
| CN | 107280175 | A | 10/2017 |
| CN | 107307532 | A | 11/2017 |
| DE | 3229776 | A1 | 4/1983 |

* cited by examiner

OUTDOOR SUNSHADE UMBRELLA AND METHOD FOR USING THE SAME

CROSS-REFERENCE TO RELATED APPLICATION

This application is based on and claims priority of Chinese Patent Application No. 201810256959.X, filed on Mar. 27, 2018, which is incorporated herein by reference in its entirety.

TECHNICAL FIELD

The present disclosure relates to the field of artificial intelligence technologies, and in particular to an outdoor sunshade umbrella and a method for using the same.

BACKGROUND

An umbrella cover of an outdoor sunshade umbrella is usually fixed at a position, and its angle cannot be adjusted. When a direction of sunlight changes, the position of the umbrella cover has to be adjusted artificially, or a position of an obscured object has to be moved, which brings inconvenience for users of the outdoor sunshade umbrella.

SUMMARY

One embodiment of the present disclosure provides an outdoor sunshade umbrella including: a supporting portion; a sunshade umbrella main body pivotally connected with the supporting portion; and a control portion configured to control the supporting portion to automatically adjust a position of the sunshade umbrella main body according to a direction of sunlight and position information of an obscured object.

In one embodiment, the supporting portion includes: a first supporting structure; a second supporting structure mounted on the first supporting structure with the second supporting structure movable relative to the first supporting structure in a first direction; a movement structure; and a third supporting structure. The movement structure is mounted on the second supporting structure. The movement structure is movable with the second supporting structure relative to the first supporting structure in the first direction and the movement structure is movable relative to the second supporting structure in a second direction; an end of the third supporting structure is connected with the movement structure; the sunshade umbrella main body is pivotally connected with another end of the third supporting structure. The sunshade umbrella main body is rotatable relative to the third supporting structure in a third direction. The control portion includes: a sun-position determination structure; an obscured-object-position determination structure; and a controller. The sun-position determination structure is configured to determine the direction of sunlight. The obscured-object-position determination structure is configured to detect the position information of the obscured object. The controller is configured to, based on the direction of sunlight and the position information of the obscured object, perform at least one of operations including: controlling the second supporting structure to move relative to the first supporting structure in the first direction; controlling the movement structure to move relative to the second supporting structure in the second direction; and controlling the sunshade umbrella main body to rotate relative to the third supporting structure in the third direction.

In one embodiment, the first direction is a periphery direction of the supporting rod, and the second direction is an axis direction of the supporting rod.

In one embodiment, the outdoor sunshade umbrella further includes a rotation portion; the first supporting structure includes a pedestal; the second supporting structure includes a supporting rod, and the supporting rod is mounted to the pedestal through the rotation portion and rotatable relative to the pedestal; and the third direction is a rotation direction in any plane parallel with the axis direction of the supporting rod around a center which is a joint between the sunshade umbrella main body and the third supporting structure.

In one embodiment, the rotation portion includes a rotation motor in the pedestal, and one end of the supporting rod is connected with the rotation motor through a transmission shaft.

In one embodiment, the movement structure includes a supporting frame, a screw rod and a lifting motor; the supporting frame includes a first portion and a second portion that is perpendicularly disposed on the first portion; the third supporting structure is fixed to the first portion or the second portion; the screw rod is fixed to the supporting rod or is formed of external threads at an outer periphery surface of the supporting rod; and the first portion is disposed around the screw rod; the lifting motor is fixed to the second portion; and the lifting motor is connected with the screw rod through a gear set, thereby enabling the supporting frame to move along an axis direction of the screw rod.

In one embodiment, the movement structure further includes a reinforcing rod; one end of the reinforcing rod is pivotally mounted to one end of the supporting rod away from the pedestal, and another end of the reinforcing rod is pivotally mounted to a middle portion of the third supporting structure.

In one embodiment, the first direction is an axis direction of the supporting rod, and the second direction is a periphery direction of the supporting rod.

In one embodiment, the outdoor sunshade umbrella further includes a cylinder with an output shaft; the first supporting structure includes a pedestal; the second supporting structure includes a supporting rod; the cylinder is within the pedestal; the supporting rod is mounted to the output shaft of the cylinder; the third direction is a rotation direction in any plane parallel with the axis direction of the supporting rod around a center which is a joint between the sunshade umbrella main body and the third supporting structure.

In one embodiment, the movement structure includes a bearing disposed around the supporting rod, a driver motor and a driver gear mounted to an output shaft of the driver motor; an inner ring of the bearing is fixed to the supporting rod; teeth are formed at an outside of an outer ring of the bearing; the teeth of the bearing engage with the driver gear; the third supporting structure is fixed to the outer ring of the bearing; and the driver motor is mounted to the supporting rod.

In one embodiment, the outdoor sunshade umbrella further includes an angle adjustment structure; the sunshade umbrella main body is pivotally mounted to another end of the third supporting structure through the angle adjustment structure; and the angle adjustment structure includes a steering engine fixed to the third supporting structure, and the sunshade umbrella main body is mounted to an output shaft of the steering engine.

In one embodiment, the outdoor sunshade umbrella further includes a wind direction detection structure for detecting current wind direction; the wind direction detection structure is at the third supporting structure; the controller is further configured to generate control information for controlling the angle adjustment structure based on the current wind direction, thereby enabling the sunshade umbrella main body to rotate.

In one embodiment, the wind direction detection structure includes a wind indicator.

In one embodiment, the sun-position determination structure includes a photosensitive member or a mobile terminal that is configured to sense the direction of sunlight.

In one embodiment, the sun-position determination structure includes: a global positioning system (GPS) positioning unit configured to determine latitude and longitude information of the sunshade umbrella main body; a clock configured to determine current time information; and a sunlight direction determination circuit configured to obtain current direction of sunlight according to the latitude and longitude information and the time information.

In one embodiment, the sunshade umbrella main body includes an umbrella handle, an umbrella cover, and ribs connected between the umbrella handle and the umbrella cover; the outdoor sunshade umbrella further includes a sunshade umbrella switch at the umbrella handle; and the sunshade umbrella switch is configured to control movement of the ribs, thereby realizing opening or closing of the umbrella cover.

In one embodiment, the outdoor sunshade umbrella further includes a spray structure; the spray structure includes: a container with an opening defined at one end of the container; wherein the container is configured to store water and is disposed at a top of the sunshade umbrella main body, and the opening of the container is away from the sunshade umbrella main body; a duct; wherein an end of the duct is communicated with the container, and the other end of the duct extends through the umbrella cover to one side of the sunshade umbrella main body away from the container; and a nozzle configured to spray the obscured object and disposed at one end of the duct away from the container.

In one embodiment, the spray structure further includes a temperature detection structure for detecting ambient temperature; the control portion is further configured to control the nozzle to spray when the ambient temperature exceeds a preset temperature.

In one embodiment, the spray structure further includes a filter structure provided at the duct for filtering water in the container, and a storage structure provided at the duct for storing water filtered by the filter structure.

One embodiment of the present disclosure provides a method for using the above outdoor sunshade umbrella, including: determining a direction of sunlight and position information of an obscured object; and controlling the supporting portion to automatically adjust a position of the sunshade umbrella main body according to the direction of sunlight and the position information of the obscured object.

BRIEF DESCRIPTION OF THE DRAWINGS

A brief introduction will be given hereinafter to the accompanying drawings which will be used in the description of the embodiments in order to explain the embodiments of the present disclosure more clearly. Apparently, the drawings in the description below are merely for illustrating some embodiments of the present disclosure. Those skilled in the art may obtain other drawings according to these drawings without paying any creative labor.

DETAILED DESCRIPTION

Figure 1:
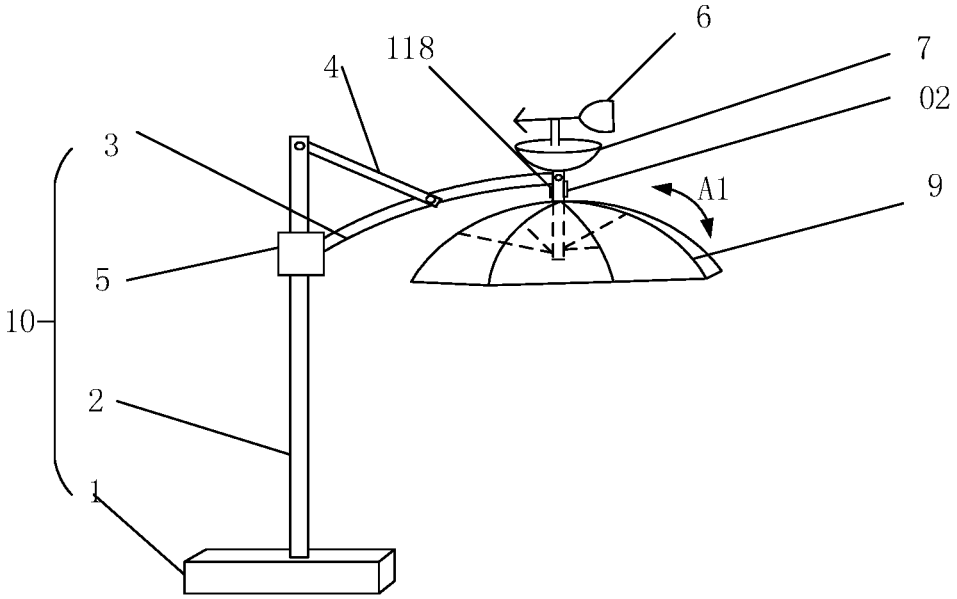
FIG. 1 is a schematic view of an outdoor sunshade umbrella according to an embodiment of the present disclosure.

Reference will now be made in detail to exemplary embodiments, examples of which are illustrated in the accompanying drawings. The following description refers to the accompanying drawings in which the same numbers in different drawings represent the same or similar elements unless otherwise indicated. The following description of exemplary embodiments is merely used to illustrate the present disclosure and is not to be construed as limiting the present disclosure.

One embodiment of the present disclosure provides an outdoor sunshade umbrella. As shown in FIG. 1 to FIG. 5, the outdoor sunshade umbrella includes a supporting portion 10, a sunshade umbrella main body 9 pivotally connected with the supporting portion 10 and a control portion. The control portion is used to control the supporting portion 10 to automatically adjust a position of the sunshade umbrella main body 9 according to a direction of sunlight and position information of an obscured object.

Specifically, the supporting portion 10 includes a first supporting structure, a second supporting structure rotatably mounted to the first supporting structure, a movement structure 5 and a third supporting structure 3. In an embodiment shown in FIG. 1, the first supporting structure may be a pedestal 1, and the second supporting structure may be a supporting rod 2. The supporting rod 2 may be rotatably mounted to the pedestal 1 through a rotation portion 04. In this way, the second supporting structure such as the supporting rod 2 is capable of being rotated relative to the first supporting structure such as the pedestal 1. The movement structure 5 is slidably mounted to the second supporting structure such as the supporting rod 2, and is capable of moving upwardly or downwardly along an axis direction of the second supporting structure such as the supporting rod 2. Meanwhile, the movement structure 5 is capable of being rotated relative to the first supporting structure such as the pedestal 1 along the second supporting structure such as the supporting rod 2.

One end of the third supporting structure 3 is connected with the movement structure 5. The third supporting structure 3 is capable of moving upwardly or downwardly along with the movement structure 5 with respect to the second supporting structure such as the supporting rod 2 in the axis direction of the second supporting structure such as the supporting rod 2. Then, the third supporting structure 3 drives the sunshade umbrella main body 9 to move upwardly or downwardly with respect to the second supporting structure such as the supporting rod 2 in the axis direction of the second supporting structure such as the supporting rod 2. In this way, a vertical position of the sunshade umbrella main body 9 may be adjusted.

Further, when the movement structure 5 is rotated along with the second supporting structure such as the supporting rod 2 with respect to the first supporting structure such as the pedestal 1, the third supporting structure 3 is capable of rotating along with the movement structure 5 with respect to the first supporting structure such as the pedestal 1. Meanwhile, the third supporting structure 3 drives the sunshade umbrella main body 9 to rotate with respect to the first supporting structure such as the pedestal 1. In this way, a horizontal position of the sunshade umbrella main body 9 may be adjusted.

The sunshade umbrella main body 9 may be pivotally mounted to another end of the third supporting structure 3, thereby enabling the sunshade umbrella main body 9 to rotate in a direction perpendicular to the horizontal plane around a center which is a joint between the sunshade umbrella main body 9 and the third supporting structure 3. In this way, an angle of the sunshade umbrella main body 9 with respect to the third supporting structure 3 may be adjusted. In one embodiment shown in FIG. 5, the sunshade umbrella main body 9 may be pivotally mounted to another end of the third supporting structure 3 through an angle adjustment structure 06.

Figure 7:
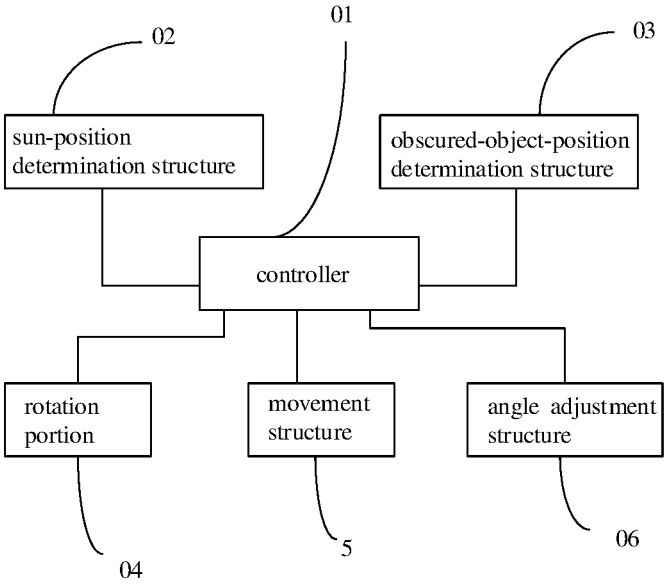
FIG. 7 is a block diagram of an outdoor sunshade umbrella according to an embodiment of the present disclosure.

The control portion includes a sun-position determination structure 02, an obscured-object-position determination structure 03 (as shown in FIG. 7) and a controller 01 (as shown in FIG. 7). The controller 01 is used to, based on information fed back by the sun-position determination structure 02 and the obscured-object-position determination structure 03, control the supporting portion 10 to automatically adjust the horizontal position of the sunshade umbrella main body 9, the vertical position of the sunshade umbrella main body 9 and the angle of the sunshade umbrella main body 9 with respect to the third supporting structure 3.

Specifically, the sun-position determination structure 02 is used to determine a direction of sunlight. The obscured-object-position determination structure 03 is used to detect position information of an obscured object. In one embodiment, the obscured-object-position determination structure may be a GPS positioning device disposed on the obscured object. The controller 01 may be disposed at the first supporting structure such as the pedestal 1. The controller 01 is used to generate control information based on the direction of sunlight and the positon information of the obscured object. Based on the control information, at least one of the rotation portion 04, the movement structure 5 and the angle adjustment structure 06 controls the sunshade umbrella main body 9 to carry out corresponding movement, thereby enabling the sunshade umbrella main body 9 to move to a preset state for shading the obscured object. In other words, based on the control information, at least one of the rotation portion 04, the movement structure 5 and the angle adjustment structure 06 controls the sunshade umbrella main body 9 to carry out corresponding movement, thereby adjusting the horizontal position of the sunshade umbrella main body 9, the vertical position of the sunshade umbrella main body 9 and the angle of the sunshade umbrella main body 9 with respect to the third supporting structure 3, and then shading the obscured object. It should be noted that, in some embodiments of the present disclosure, the angle adjustment structure enables the sunshade umbrella main body 9 to rotate in the direction perpendicular to the horizontal plane. The horizontal plane is a plane that is perpendicular to the axis direction of the supporting rod 2, i.e., the angle adjustment structure enables the sunshade umbrella main body 9 to rotate in a plane that is parallel to the axis direction of the supporting rod 2. For example, in one embodiment shown in FIG. 1, the angle adjustment structure enables the sunshade umbrella main body 9 to rotate with respect to the third supporting structure 3 in a direction indicated by an arrow A1.

Figure 5:
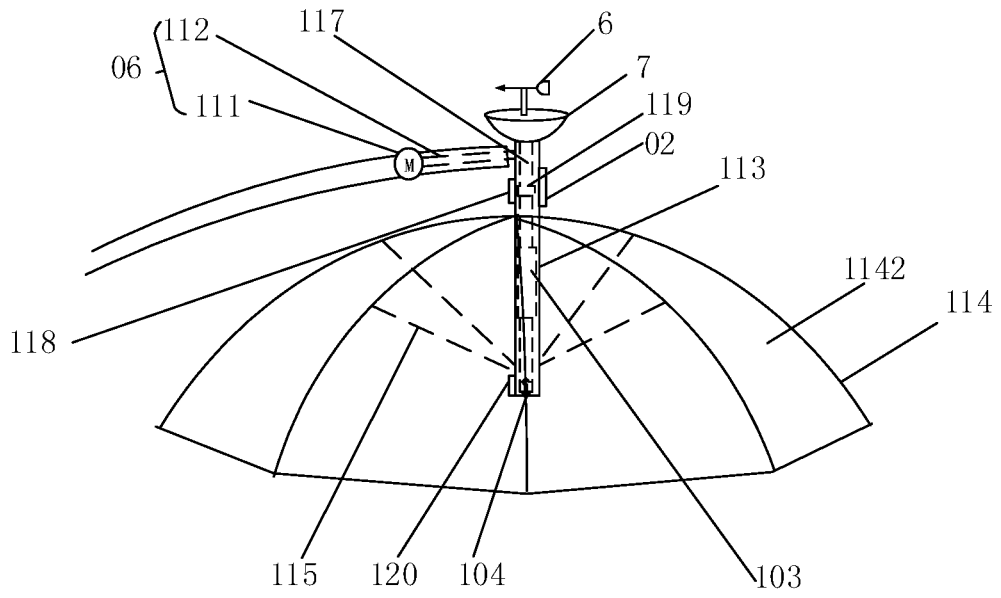
FIG. 5 is a partial schematic view of the outdoor sunshade umbrella according to an embodiment of the present disclosure.
Figure 6:
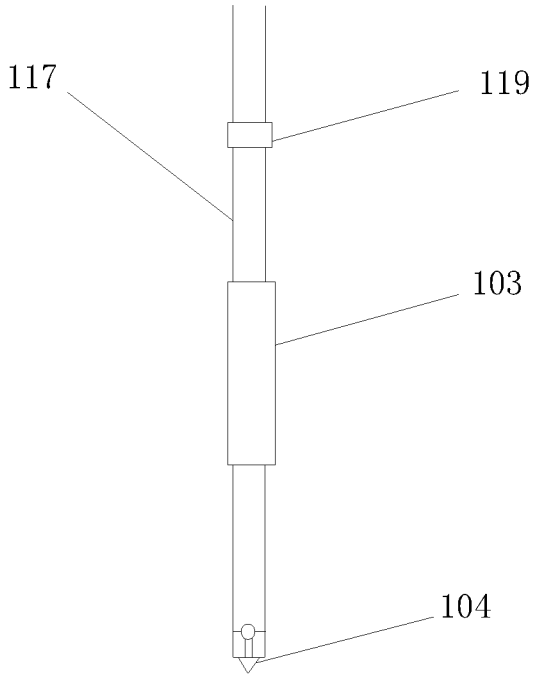
FIG. 6 is another partial schematic view of the outdoor sunshade umbrella according to an embodiment of the present disclosure.

In some embodiments of the present disclosure, as long as the positon information of the obscured object can be detected, the obscured-object-position determination structure may be disposed at the sunshade umbrella main body 9, the supporting rod 2 or the third supporting structure 3. As shown in FIG. 5, the sunshade umbrella main body 9 may include an umbrella handle 113 and an umbrella cover 114. When the obscured-object-position determination structure is disposed at the sunshade umbrella main body 9, the obscured-object-position determination structure may be disposed at a concave surface of the umbrella cover 114 (i.e., a lower surface of the umbrella cover 114 when the sunshade umbrella main body 9 is at a position shown in FIG. 5), or disposed at a portion of the umbrella handle 113 within the umbrella cover 114, thereby preventing the obscured-object-position determination structure from being unable to detect the positon information of the obscured object as the obscured-object-position determination structure is blocked by the umbrella cover 114, In some embodiments of the present disclosure, the controller includes: a receiver (i.e., a signal receiver) and a processing circuit.

The receiver is used to receive a first signal sent from the sun-position determination structure and a second signal sent from the obscured-object-position determination structure. The first signal includes the direction of sunlight. The second signal includes the position information of the obscured object.

The processing circuit is used to, based on the first signal and the second signal, generate a first control instruction for controlling the rotation portion, a second control instruction for controlling the movement structure and a third control instruction for controlling the angle adjustment structure.

The rotation portion executes the first control instruction to enable the supporting rod to rotate. Rotation of the supporting rod drives the sunshade umbrella main body to rotate in the horizontal plane to a first preset position.

The movement structure executes the second control instruction to enable the movement structure to move along the axis direction of the supporting rod, thereby enabling the sunshade umbrella main body to move to a second preset position in the vertical direction.

The angle adjustment structure executes the third control instruction to enable the sunshade umbrella main body to rotate by a preset angle in the direction perpendicular to the horizontal plane.

Cooperation among the rotation portion, the movement structure and the angle adjustment structure can automatically adjust the position and the angle of the sunshade umbrella main body according to the position information of the obscured object as the direction of sunlight changes, thereby providing convenience for users.

In one embodiment, the preset state includes that the umbrella cover of the sunshade umbrella main body 9 is perpendicular to the direction of sunlight. It should be noted that the umbrella cover is usually a curved surface, and the term perpendicular herein means that a plane defined by an edge of the umbrella is perpendicular to the direction of sunlight.

When the obscured object moves in a certain range, the preset state further includes that a connection line from a center of the umbrella cover of the sunshade umbrella main body 9 to the obscured object is parallel to the direction of sunlight, and the umbrella cover of the sunshade umbrella main body 9 is perpendicular to the direction of sunlight. It should be noted that the umbrella cover is usually a curved surface, and the term perpendicular herein means that a plane defined by an edge of the umbrella is perpendicular to the direction of sunlight.

The above settings of the preset state are optional examples in some embodiments. In actual application, the settings of the preset state may be adjusted according to actual needs and are not limited thereto.

It should be noted that, corresponding detection functions of the sun-position determination structure and the obscured-object-position determination structure may be performed in real time or performed periodically according to a preset period of time, which will be described hereinafter.

When the corresponding detection functions of the sun-position determination structure and the obscured-object-position determination structure are performed in real time, the sun-position determination structure detects in real time the direction of sunlight, and the obscured-object-position determination structure detects in real time the position information of the obscured object. The receiver receives in real time a first signal sent from the sun-position determination structure and a second signal sent from the obscured-object-position determination structure. The first signal includes the direction of sunlight and the second signal includes the position information of the obscured object. Based on the first signal and the second signal, the processing circuit generates in real time a first control instruction for controlling the rotation portion, a second control instruction for controlling the movement structure and a third control instruction for controlling the angle adjustment structure. The rotation portion, the movement structure and the angle adjustment structure execute in real time corresponding instructions, respectively, to adjust in real time the position and angle of the sunshade umbrella main body.

When the corresponding detection functions of the sun-position determination structure and the obscured-object-position determination structure are performed periodically according to the preset period of time, the sun-position determination structure detects periodically the direction of sunlight according to the preset period of time, and the obscured-object-position determination structure detects periodically the position information of the obscured object according to the preset period of time. The receiver receives a first signal periodically sent from the sun-position determination structure and a second signal periodically sent from the obscured-object-position determination structure. The first signal includes the direction of sunlight and the second signal includes the position information of the obscured object. Based on the first signal and the second signal, the processing circuit generates a first control instruction for controlling the rotation portion, a second control instruction for controlling the movement structure and a third control instruction for controlling the angle adjustment structure. The rotation portion, the movement structure and the angle adjustment structure execute corresponding instructions, respectively, to adjust the position and angle of the sunshade umbrella main body according to the preset period of time.

Figure 2:
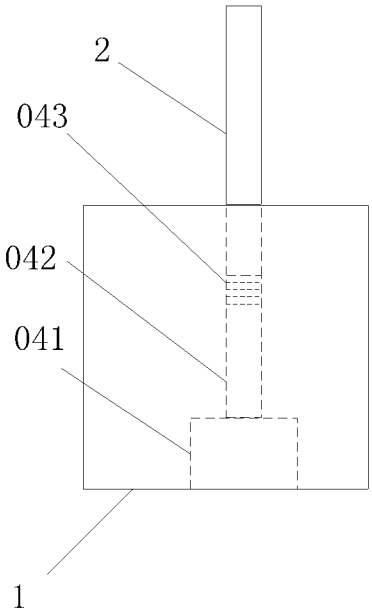
FIG. 2 is a schematic view of a rotation portion of the outdoor sunshade umbrella according to an embodiment of the present disclosure.

The rotation portion 04 may be in a variety of forms, as long as it can rotate the supporting rod 2. In one embodiment, as shown in FIG. 2, the rotation portion includes a rotation motor 041 disposed in the pedestal 1. One end of the supporting rod 2 is connected with the rotation motor 041 through a transmission shaft 042.

The transmission shaft 042 may be mounted to the supporting rod 2 by means of screw connection. Specifically, one end of the transmission shaft 042 is provided with external threads. A hole is defined in one end of the supporting rod 2 and extends along the axis direction of the supporting rod 2. Internal threads are provided at an inner wall of the supporting rod 2 that defines the hole. The transmission shaft 042 is inserted into the hole and mounted to supporting rod 2 via engagement between the external threads and the internal threads. Dot lines in FIG. 2 represent a screw connection portion 043 between the transmission shaft 042 and the supporting rod 2.

When the supporting rod 2 is driven by the rotation motor to rotate, the third supporting structure 3 rotates synchronously along with the supporting rod 2 as the third supporting structure 3 is connected with the supporting rod 2 through the movement structure 5. Then, the sunshade umbrella main body 9 rotates along with the third supporting structure 3 as the sunshade umbrella main body 9 is connected with the third supporting structure 3. In this way, the sunshade umbrella main body 9 is enabled to rotate in the horizontal plane (which is perpendicular to the axis direction of the supporting rod 2) around an axis of the supporting rod 2.

Figure 3:
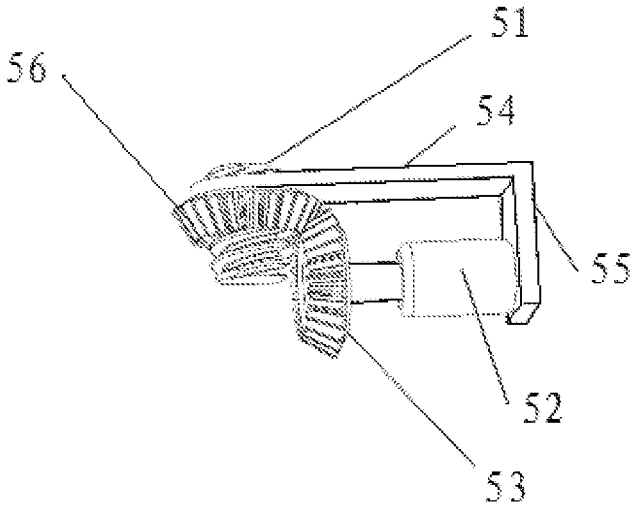
FIG. 3 is a schematic view of a movement structure of the outdoor sunshade umbrella according to an embodiment of the present disclosure.

The movement structure 5 may be in a variety of forms, as long as the movement structure 5 can drive the third supporting structure 3 to move. In one embodiment, as shown in FIG. 3, the movement structure 5 includes a supporting frame, a screw rod 51 and a lifting motor 52. The supporting frame includes a first portion 54 and a second portion 55 that is perpendicularly disposed on the first portion 54. The third supporting structure 3 is fixed to the first portion 54 or the second portion 55. The screw rod 51 is fixed to the supporting rod 2 and is capable of rotating synchronously along with the supporting rod 2. The first portion 54 is disposed around the screw rod 51. The lifting motor 52 is fixed to the second portion 55. The lifting motor 52 is connected with the screw rod 51 through a gear set, thereby enabling the supporting frame to move along an axis direction of the screw rod 51.

The gear set includes a first helical gear 56 and a second helical gear 53 that engages with the first helical gear 56. The first helical gear 56 is threadably disposed around the screw rod 51. The second helical gear 53 is mounted to an output shaft of the lifting motor 52. In one embodiment shown in FIG. 3, the output shaft of the lifting motor 52 is perpendicular to the screw rod 51.

It should be noted that, in one embodiment, the screw rod 51 is parallel with the supporting rod 2, and the screw rod 51 may be fixed to the supporting rod 2 by means of a connection piece such as a clamp. In other embodiments, the screw rod 51 may be formed by forming external threads at an outer periphery surface of the supporting rod 2.

Figure 4:
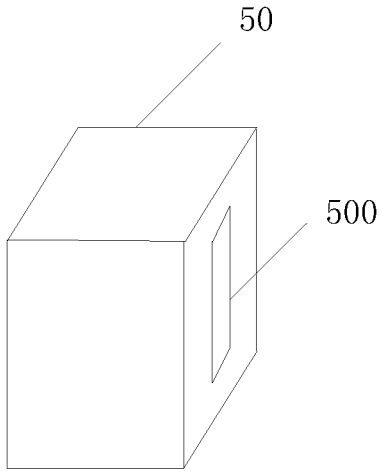
FIG. 4 is a schematic view of a box of the outdoor sunshade umbrella according to an embodiment of the present disclosure.

Optionally, as shown in FIG. 1 and FIG. 4, the supporting frame may further include a box 50 disposed around the supporting rod 2. The box 50 covers the screw rod 51, the lifting motor 52, the first portion 54 and the second portion 55. The third supporting structure 3 may be fixed to the second portion 55. A rectangular opening 500 is defined in one side of the box 50 that corresponds to the second portion 55. The rectangular opening 500 extends in a direction that is parallel with the supporting rod 2. The third supporting structure 3 is capable of moving in the rectangular opening 500.

When the lifting motor 52 works, through the gear set, the lifting motor 52 drives the first portion 54 and the second portion 55 to move along the axis direction of the screw rod 51. Accordingly, the third supporting structure 3 moves along the axis direction of the screw rod 51, and then the sunshade umbrella main body 9 moves upwardly or downwardly along with the third supporting structure 3.

In one embodiment, as shown in FIG. 1, the movement structure further includes a reinforcing rod 4. One end of the reinforcing rod 4 is pivotally mounted to one end of the supporting rod 2 away from the pedestal 1. Another end of the reinforcing rod 4 is pivotally mounted to a middle portion of the third supporting structure 3. The presence of the reinforcing rod 4 enhances stability of connection between the supporting rod 2 and the third supporting structure 3, and enhances the strength of the third supporting structure 3 to prevent the third supporting structure 3 from being damaged.

The angle adjustment structure 06 may be in a variety of forms, as long as the angle adjustment structure 06 can adjust the angle of the sunshade umbrella main body 9. In one embodiment, as shown in FIG. 5, the angle adjustment structure 06 includes a steering engine 111 fixed to the third supporting structure 3, and the sunshade umbrella main body 9 is mounted to an output shaft 112 of the steering engine 111. One end of the umbrella handle 113, which extends outside the umbrella cover 114 is connected with the output shaft 112.

The sun-position determination structure may be in a variety of forms. In one embodiment, the sun-position determination structure includes a photosensitive member or a mobile terminal that is used to sense the direction of sunlight.

When the sun-position determination structure includes the photosensitive member, the photosensitive member may be disposed at the end of the umbrella handle 113 (i.e., the sun-position determination structure 02 shown in FIG. 1), which extends outside the umbrella cover 114, or disposed at a convex surface 1142 of the umbrella cover 114, so that the photosensitive member is exposed to sunlight and then determines the direction of sunlight.

When the sun-position determination structure is the mobile terminal, the mobile terminal can determine the direction of sunlight no matter whether the mobile terminal is exposed to sunlight. For example, the mobile terminal can obtain the direction of sunlight through the internet, and thus the mobile phone may be at any position for instance, the mobile terminal may be disposed at the umbrella cover 114, the umbrella handle 113, the supporting rod 2 or the pedestal 1. The mobile terminal may be communicated with the control portion through wireless connection, thus the mobile terminal is not necessarily fixed to a certain part of the outdoor sunshade umbrella and may be disposed separately, such as a handheld mobile phone.

Figure 8:
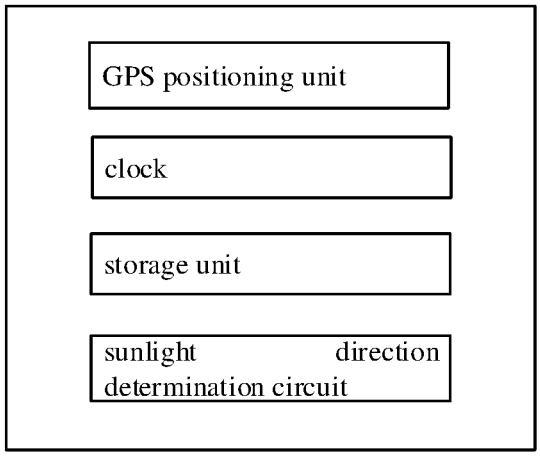
FIG. 8 is a schematic view of a sun-position determination structure of the outdoor sunshade umbrella according to an embodiment of the present disclosure.

In one embodiment, as shown in FIG. 8, the sun-position determination structure may include a GPS positioning unit, a clock, a storage unit (e.g., a memory), and a sunlight direction determination circuit.

The GPS positioning unit is used to determine latitude and longitude information of the sunshade umbrella main body 9. The clock is used to determine current time information. The storage unit is used to store correspondence relationship between the latitude and longitude, sun azimuth and solar elevation angle in a certain period of time, i.e., one year. The sunlight direction determination circuit is used to obtain current direction of sunlight according to the latitude and longitude information and the time information.

In this embodiment, the GPS positioning unit determines the latitude and longitude information of the sunshade umbrella main body 9; the clock determines the current time information; the control portion or the storage unit stores the correspondence relationship between the latitude and longitude, sun azimuth and solar elevation angle in a certain period of time, i.e., one year; the sunlight direction determination circuit obtains position information of the sun and the direction of sunlight according to the latitude and longitude information and the time information; and the control portion generates the control information to control the sunshade umbrella main body 9 to move for shading. In one embodiment, the sunlight direction determination circuit and the processing circuit of the control portion may be implemented by an identical processor or different processors.

FIG. 7 is a block diagram of an outdoor sunshade umbrella according to an embodiment of the present disclosure. Based on the direction of sunlight sent from the sun-position determination structure 02 and the position information of an obscured object sent from the obscured-object-position determination structure 03, the controller 01 generates the control information. The control information is used to control the rotation portion 04 to move, thereby rotating the sunshade umbrella main body 9 in the horizontal plane. The control information is further used to control the movement structure 5 to move, thereby moving the sunshade umbrella main body 9 upwardly or downwardly in the vertical direction. The control information is further used to control the angle adjustment structure 06 to move, thereby rotating the sunshade umbrella main body 9 in a direction perpendicular to the horizontal plane.

In order to further facilitate users, in one embodiment, the sunshade umbrella main body 9 includes the umbrella handle 113, the umbrella cover 114, and ribs 115 connected between the umbrella handle 113 and the umbrella cover 114. In addition, the outdoor sunshade umbrella further includes a sunshade umbrella switch 120 (as shown in FIG. 5), thereby realizing automatically opening or closing of the outdoor sunshade umbrella.

The sunshade umbrella switch is connected with ends of the ribs 115, where the ends of the ribs are connected with the umbrella handle 113. The sunshade umbrella switch controls the ribs 115 to move along an axis direction of the umbrella handle 113, thereby controlling the opening or closing of the ribs 115 and then controlling the opening or closing of the umbrella cover 114.

In one embodiment, the outdoor sunshade umbrella further includes a spray structure. As shown in FIG. 5, the spray structure includes a container 7 with an opening defined at one end thereof, a duct 117 and a nozzle 104.

The container 7 is used to store water. The container 7 may be disposed at a top of the sunshade umbrella main body 9, and the opening of the container 7 is away from the sunshade umbrella main body 9.

An end of the duct 117 is communicated with the container 7, and the other end of the duct 117 extends through the umbrella cover to one side of the sunshade umbrella main body 9 away from the container 7.

The nozzle 104 is mounted to one end of the duct 117 away from the container 7. The nozzle 104 is used to spray the obscured object.

Water in the container 7 may be put in artificially or collected when it rains.

The nozzle 104 may be provided with a manual switch. When the user needs to control the nozzle 104 to spray for cooling, the nozzle 104 may be operated manually to spray.

When an ambient temperature exceeds a preset temperature (i.e., 30 degrees), the spray structure spays the obscured object to cool the obscured object, thereby preventing the obscured object from being burned by high temperature.

In one embodiment, the spray structure may further include a temperature detection structure for detecting the ambient temperature. The control portion is further used to control the nozzle 104 to spray when the ambient temperature exceeds the preset temperature.

In one embodiment, the temperature detection structure may be a temperature sensor 118 disposed at a lateral wall of one portion of the umbrella handle 113, where the one portion of the umbrella handle 113 extends outside of the umbrella cover 114.

In one embodiment, the umbrella handle 113 is a hollow structure. One end of the duct 117 is communicated with the container 7, and the other end of the duct 117 extends through the umbrella handle 113 to be communicated with the nozzle 104.

The container 7 is open at one end, i.e., the container is disposed in open air. In order to keep spray clean to prevent the obscured object from being polluted, in one embodiment, a filter structure 119 is provided at the duct 117 for filtering water in the container 7, and a storage structure 103 is provided at the duct 117 for storing water filtered by the filter structure 119.

Specific structures and positions of the filter structure 119 may be varied, as long as the filter structure 119 can filter water in the container 7. In one embodiment, the filter structure 119 may be small enough to be installed within the duct 117 for simplifying structures.

Specific structures and positions of the storage structure 103 may be varied, as long as the storage structure 103 can store water. The storage structure 103 may also be disposed between the duct 117 and the nozzle 104. In some embodiments, the storage structure 103 may also be disposed at the duct 117, in other words, one portion of the duct 117 is used to store water.

In one embodiment, the duct 117 may be divided into three sub-ducts by the filter structure 119 and the storage structure 103.

In one embodiment, the third supporting structure 3 is further provided with a wind direction detection structure 6 for detecting current wind direction.

The controller 01 is further used to generate control information for controlling the angle adjustment structure 06 based on the current wind direction, thereby enabling the sunshade umbrella main body 9 to rotate for shielding the obscured object.

In one embodiment, the outdoor sunshade umbrella may be used for shading in sunny days or rain protection in rainy days. When an ambient illumination is lower than a preset value and an air relative humidity is close to 100% (in some embodiments, the spray structure further includes a humidity detection structure for detecting an environmental humidity), a rainy day mode is turned on. At this point, the sun-position determination structure stops working, the wind direction detection structure 6 detects the current wind direction, and the control portion generates control information for controlling the angle adjustment structure 06 based on the current wind direction, thereby enabling the sunshade umbrella main body 9 to rotate for shielding the obscured object.

Optionally, the angle adjustment structure 06 controls the sunshade umbrella main body 9 to move until the umbrella cover is opposite to the rain, thereby effectively shielding the obscured object from rain and facilitating the container 7 for collecting rainwater.

Of course, in actual application, the umbrella cover is not necessarily opposite to the rain, and the umbrella cover may be disposed with a preset angle defined between the umbrella cover and the rain, as long as the umbrella cover can shield the obscured object from rain.

In one embodiment, the wind direction detection structure 6 includes, but not limited to, a wind indicator.

Figure 9:
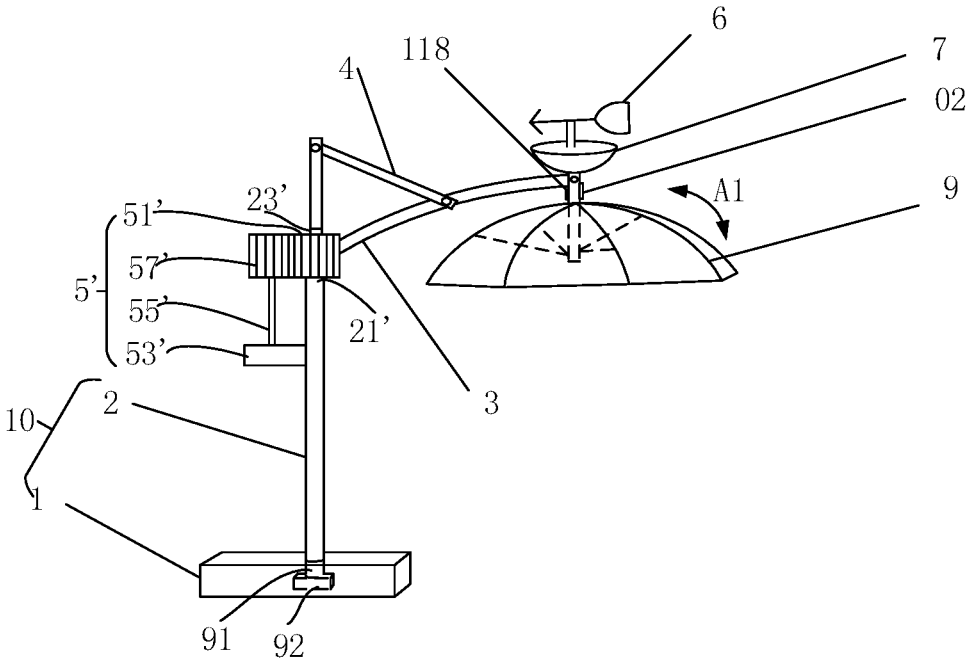
FIG. 9 is a schematic view of an outdoor sunshade umbrella according to another embodiment of the present disclosure.

In the above embodiment, the second supporting structure such as the supporting rod 2 is capable of being rotated relative to the first supporting structure such as the pedestal 1 along a periphery direction of the supporting rod 2 (which is also referred as a first direction); the movement structure 5 is capable of moving upwardly or downwardly relative to the second supporting structure such as the supporting rod 2 along the axis direction of the second supporting structure such as the supporting rod 2 (which is also referred as a second direction); and the sunshade umbrella main body 9 is capable of rotating relative to the third supporting structure 3 along a third direction (which is indicated by an arrow A1 shown in FIG. 1). The third direction is a rotation direction in a plane parallel with the axis direction of the supporting rod 2 around a center which is the joint between the sunshade umbrella main body 9 and the third supporting structure 3. In other embodiments, as shown in FIG. 9, the second supporting structure such as the supporting rod 2 is capable of moving upwardly or downwardly relative to the first supporting structure such as the pedestal 1 along the axis direction of the second supporting structure such as the supporting rod 2 (which is also referred as a first direction); the movement structure 5' is capable of being rotated relative to the second supporting structure such as the supporting rod 2 along a periphery direction of the supporting rod 2 (which is also referred as a second direction); and the sunshade umbrella main body 9 is capable of rotating relative to the third supporting structure 3 along a third direction (which is indicated by an arrow A1 shown in FIG. 9). The third direction is a rotation direction in a plane parallel with the axis direction of the supporting rod 2 around a center which is the joint between the sunshade umbrella main body 9 and the third supporting structure 3.

Specifically, structures shown in FIG. 9 are similar to those shown in FIG. 1, and the difference between them lies in that in FIG. 9, the second supporting structure such as the supporting rod 2 is capable of moving upwardly or downwardly relative to the first supporting structure such as the pedestal 1 along the axis direction of the second supporting structure such as the supporting rod 2 (which is also referred as the first direction), and the movement structure 5' is capable of being rotated relative to the second supporting structure such as the supporting rod 2 along the periphery direction of the supporting rod 2 (which is also referred as the second direction).

The movement structure 5' includes a bearing 51' disposed around the supporting rod 2, a driver motor 53' and a driver gear 57' mounted to an output shaft 55' of the driver motor.

An inner ring of the bearing 51' is fixed to the supporting rod 2. In one embodiment, a position of the bearing 51' at a periphery direction of the supporting rod 2 may be limited by a shaft shoulder 21' and a snap ring 23'. Teeth are formed at an outside of an outer ring of the bearing 51'. The teeth of the bearing engage with the driver gear 57'. The third supporting structure 3 is fixed to the bearing. The driver motor 53' may be mounted to the supporting rod 2.

In addition, the outdoor sunshade umbrella further includes a cylinder 92 with an output shaft 91. The first supporting structure includes a pedestal. The second supporting structure includes a supporting rod. The cylinder 92 is disposed within the first supporting structure such as the pedestal 1. The second supporting structure such as the supporting rod 2 is mounted to the output shaft 91 of the cylinder 92.

In the embodiment shown in FIG. 9, when the cylinder 92 works, the cylinder 92 controls the output shaft 91 to expand and contract, thereby driving the supporting rod 2 to move upwardly or downwardly and then driving the movement structure 5', the third supporting structure 3 and the sunshade umbrella main body 9 to move upwardly or downwardly. When the driver motor 53' works, through engagement between the driver gear 57' and the teeth at the outside of the outer ring of the bearing 51', the outer ring of the bearing 51' is driven to rotate relative to the supporting rod 2 and then the sunshade umbrella main body 9 is driven to rotate relative to the supporting rod 2. In this way, positions of the sunshade umbrella main body 9 in the horizontal direction and in the vertical direction are adjusted.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. An outdoor sunshade umbrella comprising:

a supporting portion;

a sunshade umbrella main body pivotally connected with the supporting portion; and a control portion configured to control the supporting portion to automatically adjust a position of the sunshade umbrella main body according to a direction of sunlight and position information of an obscured object, wherein the supporting portion includes:

a first supporting structure;

a second supporting structure mounted in the first supporting structure, wherein the second supporting structure is movable relative to the first supporting structure in a first direction;

a movement structure; and a third supporting structure;

wherein the movement structure is mounted on the second supporting structure, the movement structure is movable with the second supporting structure relative to the first supporting structure in the first direction and the movement structure is movable relative to the second supporting structure in a second direction;

wherein a first end of the third supporting structure is connected with the movement structure;

wherein the sunshade umbrella main body is pivotally connected with a second end of the third supporting structure, and the sunshade umbrella main body is rotatable relative to the third supporting structure in a third direction; and wherein the control portion includes:

a sun-position determination structure;

an obscured-object-position determination structure; and a controller;

wherein the sun-position determination structure is configured to determine the direction of sunlight; the obscured-object-position determination structure is configured to detect the position information of the obscured object; and the controller is configured to, based on the direction of sunlight and the position information of the obscured object, perform at least one of operations including:

controlling the second supporting structure to move relative to the first supporting structure in the first direction;

controlling the movement structure to move relative to the second supporting structure in the second direction; and/or controlling the sunshade umbrella main body to rotate relative to the third supporting structure in the third direction.

2. The outdoor sunshade umbrella of claim 1, wherein the first direction is a periphery direction of a supporting rod, and the second direction is an axis direction of the supporting rod.

3. The outdoor sunshade umbrella of claim 2, wherein:

the outdoor sunshade umbrella further includes a rotation portion;

the first supporting structure includes a pedestal; the second supporting structure includes the supporting rod, and the supporting rod is mounted to the pedestal through the rotation portion and rotatable relative to the pedestal; and the third direction is a rotation direction around a center in any plane parallel with the axis direction of the supporting rod, wherein the center is a joint between the sunshade umbrella main body and the third supporting structure.

4. The outdoor sunshade umbrella of claim 3, wherein the rotation portion includes a rotation motor in the pedestal, and one end of the supporting rod is connected with the rotation motor through a transmission shaft.

5. The outdoor sunshade umbrella of claim 4, wherein:

the movement structure includes a supporting frame, a screw rod and a lifting motor;

the supporting frame includes a first portion and a second portion that is perpendicularly disposed on the first portion; the third supporting structure is fixed to the first portion or the second portion;

the screw rod is fixed to the supporting rod or is formed of external threads at an outer periphery surface of the supporting rod; and the first portion is disposed around the screw rod; and the lifting motor is fixed to the second portion; and the lifting motor is connected with the screw rod through a gear set, thereby enabling the supporting frame to move along an axis direction of the screw rod.

6. The outdoor sunshade umbrella of claim 5, wherein the movement structure further includes a reinforcing rod; a first end end of the reinforcing rod is pivotally mounted to one end of the supporting rod away from the pedestal; and a second end of the reinforcing rod is pivotally mounted to a middle portion of the third supporting structure.

7. The outdoor sunshade umbrella of claim 1, wherein the first direction is an axis direction of a supporting rod, and the second direction is a periphery direction of the supporting rod.

8. The outdoor sunshade umbrella of claim 7, wherein:

the outdoor sunshade umbrella further includes a cylinder with an output shaft;

the first supporting structure includes a pedestal; the second supporting structure includes the supporting rod; the cylinder is within the pedestal; and the supporting rod is mounted to the output shaft of the cylinder; and the third direction is a rotation direction around a center in any plane parallel with the axis direction of the supporting rod, wherein the center is a joint between the sunshade umbrella main body and the third supporting structure.

9. The outdoor sunshade umbrella of claim 8, wherein:

the movement structure includes a bearing disposed around the supporting rod, a driver motor and a driver gear mounted to an output shaft of the driver motor; and an inner ring of the bearing is fixed to the supporting rod; teeth are formed at an outside of an outer ring of the bearing; the teeth of the bearing engage with the driver gear; the third supporting structure is fixed to the outer ring of the bearing; and the driver motor is mounted to the supporting rod.

10. The outdoor sunshade umbrella of claim 1, wherein:

the outdoor sunshade umbrella further includes an angle adjustment structure; the sunshade umbrella main body is pivotally mounted to the second end of the third supporting structure through the angle adjustment structure; and the angle adjustment structure includes a steering engine fixed to the third supporting structure, and the sunshade umbrella main body is mounted to an output shaft of the steering engine.

11. The outdoor sunshade umbrella of claim 10, wherein the outdoor sunshade umbrella further includes a wind direction detection structure for detecting current wind direction; the wind direction detection structure is at the third supporting structure; and the controller is further configured to generate control information for controlling the angle adjustment structure based on the current wind direction, thereby enabling the sunshade umbrella main body to rotate.

12. The outdoor sunshade umbrella of claim 11, wherein the wind direction detection structure includes a wind indicator.

13. The outdoor sunshade umbrella of claim 11, wherein the sun-position determination structure includes a photosensitive member or a mobile terminal that is configured to sense the direction of sunlight.

14. The outdoor sunshade umbrella of claim 1, wherein the sun-position determination structure includes:

a global positioning system (GPS) positioning unit configured to determine latitude and longitude information of the sunshade umbrella main body;

a clock configured to determine current time information; and a sunlight direction determination circuit configured to obtain current direction of sunlight according to the latitude and longitude information and the time information.

15. The outdoor sunshade umbrella of claim 1, wherein the sunshade umbrella main body includes an umbrella handle, an umbrella cover, and ribs connected between the umbrella handle and the umbrella cover; the outdoor sunshade umbrella further includes a sunshade umbrella switch at the umbrella handle; and the sunshade umbrella switch is configured to control movement of the ribs, thereby realizing opening or closing of the umbrella cover.

16. The outdoor sunshade umbrella of claim 1, wherein the outdoor sunshade umbrella further includes a spray structure; the spray structure including:

a container with an opening defined at one end of the container; wherein the container is configured to store water and is disposed at a top of the sunshade umbrella main body, and the opening of the container is away from the sunshade umbrella main body;

a duct; wherein an end of the duct is communicated with the container, and the other end of the duct extends through an umbrella cover to one side of the sunshade umbrella main body away from the container; and a nozzle configured to spray the obscured object and disposed at one end of the duct away from the container.

17. The outdoor sunshade umbrella of claim 16, wherein:

the spray structure further includes a temperature detection structure for detecting ambient temperature; and the control portion is further configured to control the nozzle to spray when the ambient temperature exceeds a preset temperature.

18. The outdoor sunshade umbrella of claim 16, wherein the spray structure further includes a filter structure provided at the duct for filtering water in the container, and a storage structure provided at the duct for storing water filtered by the filter structure.

19. A method for using the outdoor sunshade umbrella of claim 1, comprising:

determining a direction of sunlight and position information of an obscured object; and controlling the supporting portion to automatically adjust a position of the sunshade umbrella main body according to the direction of sunlight and the position information of the obscured object.

* * * * *